US008085120B2

(12) United States Patent
Golner et al.

(10) Patent No.: US 8,085,120 B2
(45) Date of Patent: Dec. 27, 2011

(54) SOLID INSULATION FOR FLUID-FILLED TRANSFORMER AND METHOD OF FABRICATION THEREOF

(75) Inventors: Thomas M. Golner, Pewaukee, WI (US); Shirish P. Mehta, Waukesha, WI (US); Padma P. Varanasi, Brookfield, WI (US); Jeffrey J. Nemec, Oconomowoc, WI (US)

(73) Assignee: Waukesha Electric Systems, Incorporated, Waukesha, WI (US)

( * ) Notice: Subject to any disclaimer, the term of this patent is extended or adjusted under 35 U.S.C. 154(b) by 77 days.

(21) Appl. No.: 12/540,437

(22) Filed: Aug. 13, 2009

(65) Prior Publication Data

US 2011/0037550 A1 Feb. 17, 2011

(51) Int. Cl.
*H01F 27/08* (2006.01)

(52) U.S. Cl. ..... 336/55; 336/61; 336/90; 336/94; 174/15.1

(58) Field of Classification Search ..... 336/55, 336/61, 90, 94; 174/15.1, 25
See application file for complete search history.

(56) References Cited

U.S. PATENT DOCUMENTS

| | | | | |
|---|---|---|---|---|
| 3,086,184 | A * | 4/1963 | Nichols | 336/60 |
| 3,503,797 | A | 3/1970 | Hagiwara et al. | |
| 3,661,663 | A * | 5/1972 | Shannon | 156/62.4 |
| 3,695,984 | A * | 10/1972 | Rogers | 428/201 |
| 3,959,549 | A * | 5/1976 | Penczynski et al. | 428/213 |
| 4,009,306 | A | 2/1977 | Yamashita et al. | |
| 4,095,205 | A | 6/1978 | Schroeder et al. | |
| 4,450,424 | A | 5/1984 | Sadler et al. | |
| 5,057,353 | A | 10/1991 | Maranci et al. | |
| 6,426,310 | B1 | 7/2002 | Kurumatani et al. | |
| 6,525,272 | B2 | 2/2003 | Higashiura et al. | |
| 6,529,108 | B2 * | 3/2003 | Ito et al. | 336/57 |
| 6,538,546 | B2 * | 3/2003 | Serino et al. | 336/96 |
| 6,555,023 | B2 * | 4/2003 | Smith | 252/401 |
| 6,809,621 | B2 * | 10/2004 | Nagata et al. | 336/90 |
| 6,855,404 | B2 | 2/2005 | Anderson et al. | |
| 6,873,239 | B2 * | 3/2005 | Decristofaro et al. | 336/178 |
| 7,310,037 | B2 * | 12/2007 | Skinner et al. | 336/90 |
| 7,781,063 | B2 * | 8/2010 | Smith et al. | 428/413 |
| 7,851,059 | B2 * | 12/2010 | Stevens et al. | 428/323 |
| 7,862,669 | B2 * | 1/2011 | Pfeffer | 156/62.2 |
| 7,947,128 | B2 * | 5/2011 | Conley | 117/89 |
| 7,955,661 | B2 * | 6/2011 | Stevens et al. | 427/407.1 |

FOREIGN PATENT DOCUMENTS

WO 2009020989 A1 2/2009

OTHER PUBLICATIONS

Technical Guide for NOMEX Brand Fiber, online Manual, http://www2.dupont.com/Personal_Protection/en_US/assets/downloads/Nomex_Technical_Guide.pdf (Jul. 2001).

* cited by examiner

*Primary Examiner* — Anh Mai
*Assistant Examiner* — Joselito Baisa
(74) *Attorney, Agent, or Firm* — Baker & Hostetler LLP

(57) ABSTRACT

An insulation system for a fluid-filled power transformer that allows for operation of the transformer at higher temperatures and with lowered susceptibility to aging. The insulation system includes a plurality of fibers that are bound together by a solid binding agent. The solid binding agent may, for example, for sheaths around the fibers or may be in the form of dispersed particles that bind the fibers to each other. Also, a method of fabricating such an insulation system.

13 Claims, 3 Drawing Sheets

SOLID INSULATION FOR FLUID-FILLED TRANSFORMER AND METHOD OF FABRICATION THEREOF

FIELD OF THE INVENTION

The present invention relates generally to insulation systems included in power transformers. The present invention also relates generally to methods of fabrication of power transformers including such insulation systems

BACKGROUND OF THE INVENTION

Currently available high-voltage, fluid-filled power transformers utilize cellulose-based insulation materials that are impregnated with dielectric fluids. More specifically, such insulation systems include cellulose-based materials that are positioned between turns, between discs and sections, between layers, between windings and between components at high voltage and ground potential parts (e.g., cores, structural members and tanks).

In order to operate, currently available transformers typically include insulation materials that have a moisture content of less than 0.5% by weight. However, since cellulose naturally absorbs between 3 and 6 weight percent of moisture, a relatively costly process of heating under vacuum is typically performed before cellulose is suitable for use in a power transformer. Even pursuant to such a heating/vacuum process, as the cellulose ages (i.e., degrades over time), moisture eventually forms, as does acid, which accelerates the aging process.

Since the rate at which cellulose ages is dependent upon temperature, normal operating temperatures of currently available power transformers is 105° C. or less. For the same reason, the maximum operating temperature of such transformers is 120° C. or less. As more power is transferred, the higher losses due to higher current generate higher temperatures. As such, cellulose-based insulation systems limit the operational efficiency of power transformers.

SUMMARY OF THE INVENTION

At least in view of the above, it would be desirable to have.high-voltage, fluid-filled power transformers that are less susceptible to aging. It would also be desirable to have have.high-voltage, fluid-filled power transformers that have higher normal operating and maximum operating temperatures, as this would reduce the physical space needed to store the transformers.

The foregoing needs are met, to a great extent, by one or more embodiments of the present invention. According to one such embodiment, a power transformer is provided. The power transformer includes a first power transformer component, a second power transformer component and a cooling fluid positioned between the first power transformer component and the second transformer component. The fluid is selected to cool the first power transformer component and the second transformer component during operation of the power transformer. The power transformer also includes a solid composite structure that is positioned between the first power transformer component and the second transformer component. Particularly during operation of the power transformer, the cooling fluid is in contact with the composite structure. The composite structure itself includes a first base fiber having a first outer surface and a second base fiber having a second outer surface. In addition, the composite structure also includes a solid binder material adhering to at least a portion of the first outer surface and to at least a portion of the second outer surface, thereby binding the first base fiber to the second base fiber.

In accordance with another embodiment of the present invention, a method of fabricating a power transformer is provided. The method includes placing a binder material having a first melting temperature between a first base fiber having a second melting temperature and a second base fiber. The method also includes compressing the binder material, the first base fiber and the second base fiber together. The method further includes heating the binder material, the first base fiber and the second base fiber during the compressing step to a temperature above the first melting temperature but below the second melting temperature, thereby forming a composite structure. In addition, the method also includes positioning the composite structure between a first power transformer component and a second power transformer component. The method also includes impregnating the composite structure with a cooling fluid pursuant to the positioning step.

In accordance with yet another embodiment of the present invention, another power transformer is provided. This other power transformer includes means for performing a first function within a power transformer, means for performing a second function within the power transformer and means for cooling the power transformer. The means for cooling is typically positioned between the means for performing the first function and the means for performing the second function during operation of the power transformer. In addition, this other transformer also includes means for insulating the power transformer, wherein the means for insulating is positioned between the means for performing the first function and the means for performing the second function. Typically, the means for cooling is in contact with the means for insulating. The means for insulating itself includes first means for providing structure having a first outer surface and second means for providing structure having a second outer surface. The means for insulation also includes solid means for binding adhering to at least a portion of the first outer surface and to at least a portion of the second outer surface, thereby binding the first means for providing structure to the second means for providing structure.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
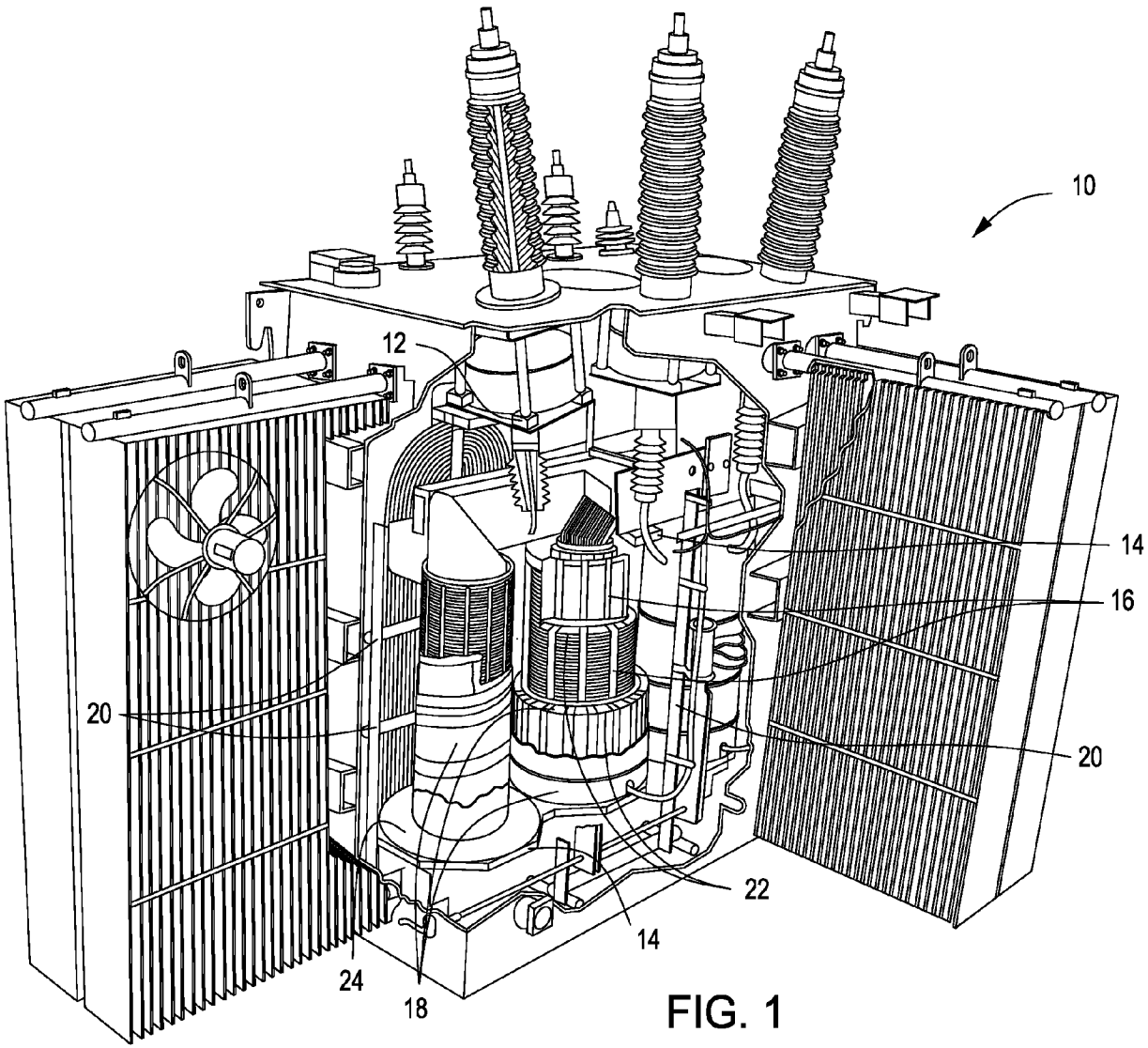
FIG. 1 is a perspective view of a cross-section of a high-voltage, fluid-filled power transformer according to an embodiment of the present invention.

Embodiments of the present invention will now be described with reference to the drawing figures, in which like reference numerals refer to like parts throughout. FIG. 1 is a perspective view of a cross-section of a high-voltage, fluid-filled power transformer 10 according to an embodiment of the present invention. As illustrated in FIG. 1, the transformer 10 includes a variety of transformer components that all may have insulation positioned between and/or around them. More specifically, the transformer 10 includes current transformer (CT) supports 12, support blocks 14, locking strips 16, winding cylinders 18, lead supports 20, radical spacers 22 and end blocks 24. (For the purpose of clarity, the insulation is not illustrated in FIG. 1.)

In operation, a cooling fluid (e.g., an electrical or dielectric insulating fluid such as, for example, a napthenic mineral oil, a paraffinic-based mineral oil including isoparaffins, synthetic esters and natural esters (e.g., FR3™)) flows between the transformer components 12, 14, 16, 18, 20, 22, 24 and is in contact with the above-mentioned insulation, typically with at least some flow therethrough as well. (Again, for the purpose of clarity, the cooling fluid is also not illustrated in FIG. 1). The cooling fluid is selected not only to cool components within the transformer 10 during the operation thereof but also to physically withstand the conditions (e.g., temperature levels, voltage and current levels, etc.) found within the transformer 10 during the operation thereof. Further, the cooling fluid is selected to be chemically inert with respect to the transformer components and with respect to the insulation that is positioned between these components.

Figure 2:
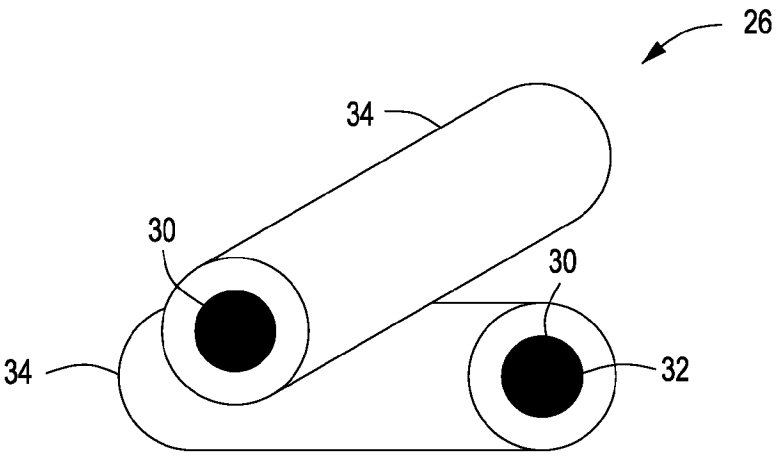
FIG. 2 includes a perspective view of a composite structure according to an embodiment of the present invention that may be used as part of an insulation system for the transformer illustrated in FIG. 1.

FIG. 2 includes a perspective view of a composite structure 26 according to an embodiment of the present invention that may be used as part of the above-mentioned insulation system for the transformer 10 illustrated in FIG. 1. The composite structure 26 illustrated in FIG. 2 includes a pair of base fibers 30 each having an outer surface 32 that has a sheath of solid binder material 34 adhered thereto. The two sheaths of binder material 34 are themselves bound to each other and therefore bind the two base fibers 30 together.

Although smaller and larger dimensions are also within the scope of the present invention, the diameter of each base fiber 30 illustrated in FIG. 2 is typically on the order of microns and the length of each base fiber 30 is typically on the order of millimeters or centimeters. As such, thousands or even millions of such base fibers 30 are bound together to form the above-mentioned insulation system. The insulation system, once formed, is then positioned between the various components of the transformer 10 illustrated in FIG. 1. Since the binder material 34 does not form a continuous matrix, the above-mentioned cooling fluid is capable of impregnating and, at least to some extent, of flowing through the composite structure 26.

Figure 3:
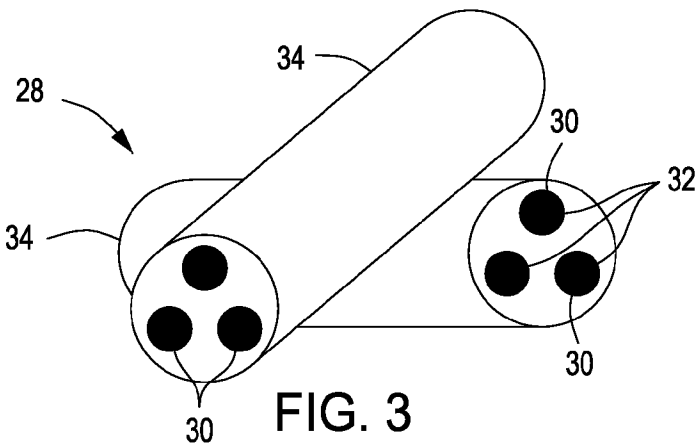
FIG. 3 includes a perspective view of a composite structure according to another embodiment of the present invention that also may be used as part of an insulation system for the transformer illustrated in FIG. 1.

FIG. 3 includes a perspective view of a composite structure 28 according to another embodiment of the present invention that also may be used as part of an insulation system for the transformer 10 illustrated in FIG. 1. Whereas the composite structure 26 illustrated in FIG. 2 has the binder material 34 forming a sheath around and along the length of only one base fiber 30, the binder material 34 illustrated in the composite structure 28 of FIG. 3 forms a sheath around and along the length of a plurality of base fibers 30. One advantage of the composite structure 26 illustrated in FIG. 2 is that it is typically relatively simple to fabricate. However, the composite structure 28 illustrated in FIG. 3 typically has greater mechanical strength.

Figure 4:
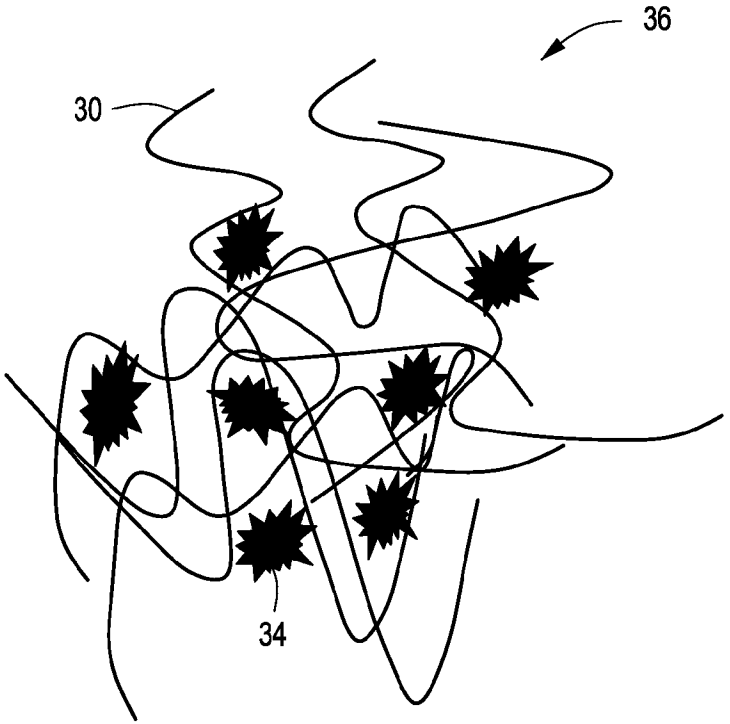
FIG. 4 includes a perspective view of a composite structure according to yet another embodiment of the present invention that also may be used as part of an insulation system for the transformer illustrated in FIG. 1.

FIG. 4 includes a perspective view of a composite structure 36 according to yet another embodiment of the present invention that also may be used as part of an insulation system for the transformer 10 illustrated in FIG. 1. As opposed to the sheaths formed in the composite structures 26, 28 illustrated in FIGS. 2 and 3, the binder material 34 in the composite structure 36 illustrated in FIG. 4 is in the form of particles that are joined to two or more base fibers 30. Although all of the composite structures discussed above allow for a transformer cooling fluid to substantially fully impregnate them, the composite structure 36 illustrated in FIG. 4 typically includes the highest degree of porosity. However, the other two composite structures 26, 28 typically have more mechanical strength.

Base fibers 30 according to the present invention may be made from any material that one of skill in the art will understand to be practical upon performing one or more embodiments of the present invention. For example, some of the base fibers 30 illustrated in FIGS. 2-4 include a staple fiber material (e.g., natural materials such as, for example, raw cotton, wool, hemp, or flax). However, the base fibers 30 illustrated in FIGS. 2-4 include a relatively high-melting-point thermoplastic material. For example, some of the illustrated base fibers include one or more of polyethylene terephthalate (PET), polyphenylene sulphide (PPS), polyetherimide (PEI), polyethylene naphthalate (PEN) and polyethersulfone (PES).

According to certain embodiments of the present invention, the base fibers 30 are made from materials/composites/alloys that are mechanically and chemically stable at the maximum operating temperature of the transformer 10. Also, for reasons that will become apparent during the subsequent discussion of methods for fabricating power transformers according to certain embodiments of the present invention, the base fibers 30 are made from materials/composites/alloys that are mechanically and chemically stable at the melting temperature of the binder material 34.

Like the base fibers 30, the binder material 34 may be any material that one of skill in the art will understand to be practical upon performing one or more embodiments of the present invention. However, the binder material 34 illustrated in FIGS. 2-4 includes at least one of an amorphous and a crystalline thermoplastic material that is mechanically and chemically stable when in contact with the above-mentioned cooling fluid. For example, according to certain embodiments of the present invention, the solid binder material 34 includes at least one of a copolymer of polyethylene terephthalate (CoPET), polybutylene terephthalate (PBT) and undrawn polyphenylene sulphide (PPS).

No particular restrictions are placed upon the relative weight or volume percentages of base fibers 30 to binder material 34 in transformers according to the present invention. However, according to certain embodiments of the present invention, the weight ratio of all base fibers 30 to all solid binder material 34 in the composite structure acting as an insulation for the transformer 10 illustrated in FIG. 1 is between approximately 8:1 and approximately 1:1. Also, although other densities are also within the scope of the present invention, the solid composite structures (e.g., composite structures 26, 28, 36) that are included in the transformer 10 illustrated in FIG. 1 have densities of between approximately 0.5 g/cm$^3$ and approximately 1.10 g/cm$^3$. Further, according to certain embodiments of the present invention, the solid binder material 34 and material in the base fibers 30 are selected to have dielectric characteristics that are substantially similar to those of the cooling fluid used in the transformer 10.

Figure 5:
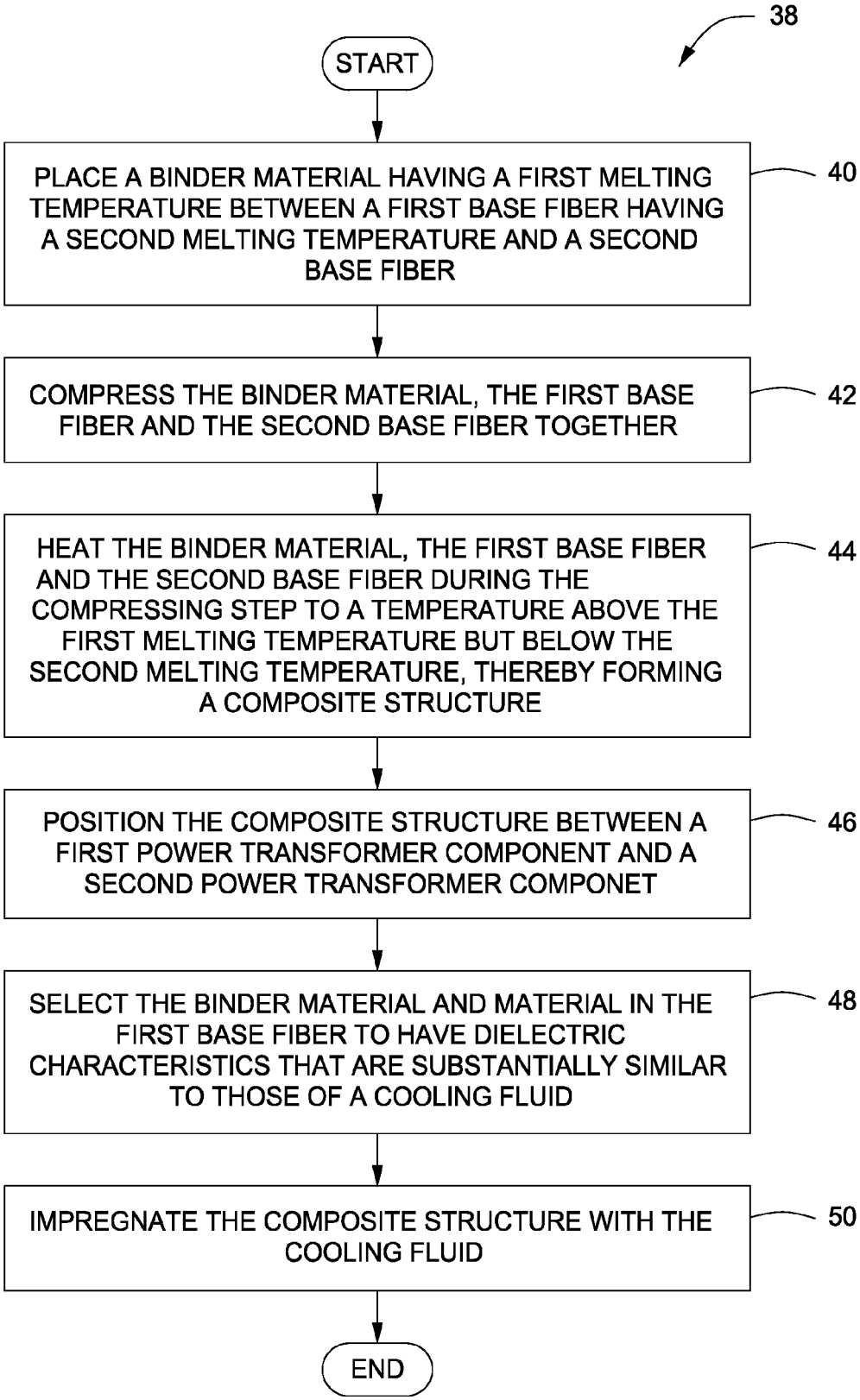
FIG. 5 is a flowchart illustrating steps of a method of fabricating a power transformer according to an embodiment of the present invention.

FIG. 5 is a flowchart 38 illustrating steps of a method of fabricating a power transformer (e.g., transformer 10) according to an embodiment of the present invention. As illustrated in FIG. 5, the first step 40 of the method specifies placing a binder material (e.g., binder material 34) having a first melting temperature between a first base fiber having a second melting temperature (e.g., the top base fiber 30 illustrated in FIG. 2) and a second base fiber (e.g., the bottom base fiber 30 illustrated in FIG. 2). When implementing this placing step 40, the binder material may, for example, take the form of full or partial sheaths around the fibers or of particles between the fibers. According to certain embodiments of the present invention, this placing step is implemented by co-extruding the binder material and a base fiber, thereby forming the sheath about a portion of the base fiber. Also, multiple fibers may be coextruded with the binder material to form structures such as those illustrated in FIG. 3.

Step 42 of the flowchart 38 illustrated in FIG. 5 specifies compressing the binder material, the first base fiber and the second base fiber together. Then, step 44 specifies heating the binder material, the first base fiber and the second base fiber during the compressing and stretching step to a temperature above the first melting temperature (i.e., the melting temperature of the binder material) but below the second melting temperature (i.e., the melting temperature of the base fiber (s)), thereby forming a composite structure (e.g., any of the composite structures 26, 28, 26 illustrated in FIGS. 2-4). According to certain embodiments of the present invention, the compressing step 42 and heating step 44 result in the composite structure having a density of between approximately 0.5 g/cm$^3$ and approximately 1.10 g/cm$^3$. However, these steps 42, 44 may be modified such that other densities are also within the scope of the present invention. It should also be noted that, according to certain embodiments of the present invention, the compressing step 42, in addition to increasing the overall density of the composite structure, also may stretch some of the fibers (e.g., base fibers 30) contained therein. This stretching sometimes results in an increased crystallinity in the composite structure, which can be beneficial in certain instances.

Once the composite structure has been formed, as specified in step 46 of the flowchart 38, the composite structure is positioned between a first power transformer component and a second transformer component. For example, the composite structure mentioned in the flowchart 38 may be placed between any or all of the current transformer (CT) supports 12, support blocks 14, locking strips 16, winding cylinders 18, lead supports 20, radical spacers 22 and/or end blocks 24 illustrated in FIG. 1. As such, according to certain embodiments of the present invention, the compressing step 42 and the heating step 44 are implemented in a manner that forms shapes that may be easily inserted into the power transformer 10 and between the above-listed components thereof.

Pursuant to the positioning step 46, step 48 specifies impregnating the composite structure with a cooling fluid. As mentioned above, the cooling fluid may be, for example, an electrical or dielectric insulating fluid. Because of the relatively open structures that the composite material may have according to certain embodiments of the present invention (e.g., either of the composite structures 26, 28 illustrated in FIGS. 2 and 3 or the composite structure 36 illustrated in FIG. 4), the impregnating step 48 can include substantially fully impregnating the composite structure with the cooling liquid. This provides for better dielectric properties than in structures wherein portions of the insulation system are less accessible to the cooling fluid.

The final step included in flowchart 38 is step 50, which specifies selecting the binder material and the material in the first base fiber to have dielectric characteristics that are substantially similar to those of the cooling fluid. Such a selection of dielectrically compatible materials allows for more efficient operation of power transformers according to the present invention.

As will be appreciated by one of skill in the art upon practicing one or more embodiments of the present invention, several advantages are provided by the apparatuses and methods discussed above. For example, the insulation systems discussed above may allow for the power transformers in which they are included to operate at higher temperatures. In fact, according to certain embodiments of the present invention, operating temperature range of between 155° C. and 180° C. are attainable, though these temperature ranges are not limiting of the overall invention. Since higher operating temperature reduce the size requirements of power transformers, transformers according to the present invention designed for a particular application may be smaller than currently available transformers, thereby requiring fewer materials and reducing the overall cost of forming/manufacturing the transformer.

Because of the enhanced insulating and cooling of certain power transformers according to the present invention, more megavolt ampere (MVA) (i.e., electrical power) may be provided from transformers having a smaller physical footprint than currently available transformers. Also, because of the novel composition of the components in the above-mentioned insulation systems, certain transformers according to the present invention reduce the probability of endangering the reliability of the transformer due to thermal overload. In addition, the novel structure of the insulation systems discussed above make them more capable of retaining their compressible characteristics over time then currently available systems (i.e., there is less creep and no need to retighten).

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A power transformer, comprising:

a first power transformer component;

a second power transformer component;

a cooling fluid, positioned between the first power transformer component and the second transformer component, to cool the first power transformer component and the second transformer component during operation of the power transformer; and a solid composite structure, positioned between the first power transformer component and the second transformer component and in contact with the cooling fluid, including:

a first base fiber having an outer surface to which a sheath of solid binder material is adhered, and a second base fiber having an outer surface to which a sheath of solid binder material is adhered, wherein the first base fiber and the second base fiber are bound together by the sheaths.

2. The power transformer of claim 1, wherein the first base fiber comprises a high melting point thermoplastic material.

3. The power transformer of claim 1, wherein the first base fiber comprises at least one of polyethylene terephthalate (PET), polyphenylene sulphide (PPS), polyetherimide (PEI), polyethylene naphthalate (PEN) and polyethersulfone (PES).

4. The power transformer of claim 1, wherein the first base fiber is stable at a maximum operating temperature of the transformer and at the melting temperature of the binder material.

5. The power transformer of claim 1, wherein the solid composite structure has a density of between approximately 0.5 g/cm$^3$ and approximately 1.10 g/cm$^3$.

6. The power transformer of claim 1, wherein the first base fiber comprises a staple fiber material.

7. The power transformer of claim 1, wherein the solid binder material comprises at least one of an amorphous and a crystalline thermoplastic material that is stable when in contact with the cooling fluid.

8. The power transformer of claim 1, wherein the solid binder material comprises at least one of a copolymer of polyethylene terephthalate (CoPET), polybutylene terephthalate (PBT) and undrawn polyphenylene sulphide (PPS).

9. The power transformer of claim 1, wherein the solid binder material and material in the first base fiber have dielectric characteristics that are substantially similar to those of the cooling fluid.

10. The power transformer of claim 1, wherein the solid composite structure is substantially fully impregnable by the cooling fluid.

11. The power transformer of claim 1, wherein a weight ratio of all base fibers to all solid binder material in the composite structure is between approximately 8:1 and approximately 1:1.

12. The power transformer of claim 1, wherein the first base fiber includes a plurality of individual fibers and the second base fiber includes a plurality of individual fibers.

13. A power transformer, comprising:

a first power transformer component;

a second power transformer component;

a cooling fluid positioned between the first power transformer component and the second transformer component, to cool the first power transformer component and the second transformer component during operation of the power transformer; and a solid composite structure, positioned between the first power transformer component and the second transformer component and in contact with the cooling fluid, including:

a first base fiber, a second base fiber, and a solid binder material that forms particles joined to the first base fiber and to the second base fiber.

* * * * *

UNITED STATES PATENT AND TRADEMARK OFFICE

CERTIFICATE OF CORRECTION

PATENT NO. : 8,085,120 B2
APPLICATION NO. : 12/540437
DATED : December 27, 2011
INVENTOR(S) : Golner et al.

It is certified that error appears in the above-identified patent and that said Letters Patent is hereby corrected as shown below:

In the Specification

Column 1, line 4, after "SOLID INSULATION FOR FLUID-FILLED TRANSFORMER AND METHOD OF FABRICATION THEREOF", and before "FIELD OF THE INVENTION", please insert:

--GOVERNMENT LICENSE RIGHTS

This invention was made with government support under NFE-06-00176, DE-AC05-00OR22725, and/or DE-FC02-06CH11355 awarded by the Department of Energy. The government has certain rights in the invention.--

Signed and Sealed this
Fifteenth Day of October, 2013

Teresa Stanek Rea

Teresa Stanek Rea
*Deputy Director of the United States Patent and Trademark Office*